US007770524B1

(12) United States Patent
Wa

(10) Patent No.: US 7,770,524 B1
(45) Date of Patent: Aug. 10, 2010

(54) DRIVE AND SECURE MECHANISM FOR TOY VEHICLE AND TRACK

(75) Inventor: Choi Man Wa, Fanling (HK)

(73) Assignee: Battat Incorporated, Plattsburgh, NY (US)

( * ) Notice: Subject to any disclaimer, the term of this patent is extended or adjusted under 35 U.S.C. 154(b) by 775 days.

(21) Appl. No.: 11/399,758

(22) Filed: Apr. 7, 2006

Related U.S. Application Data

(63) Continuation-in-part of application No. 10/686,368, filed on Oct. 14, 2003, now Pat. No. 7,051,948, which is a continuation-in-part of application No. 10/266,526, filed on Oct. 8, 2002, now Pat. No. 6,631,850.

(51) Int. Cl.
*B61C 13/00* (2006.01)

(52) U.S. Cl. ..... 105/29.2; 446/410; 238/10 R; 238/10 A; 238/10 F; 238/123; 105/1.5; 104/140

(58) Field of Classification Search ..... 105/77, 105/78, 29.1, 29.2, 1.5; 238/10 R, 10 A, 238/10 F, 123; 104/283, 140, 145, 305; 446/410
See application file for complete search history.

(56) References Cited

U.S. PATENT DOCUMENTS

| | | | | |
|---|---|---|---|---|
| 1,541,589 A | | 6/1925 | Rossini | |
| 2,838,009 A | * | 6/1958 | Bonanno | 105/77 |
| 3,337,985 A | | 8/1967 | Ryan et al. | |
| 3,350,953 A | | 11/1967 | Stewart | |
| 3,540,153 A | * | 11/1970 | Aoki | 446/446 |
| 4,221,076 A | | 9/1980 | Ozawa | |
| 4,940,444 A | | 7/1990 | Russell | |
| 5,218,909 A | | 6/1993 | Ng | |
| 5,342,048 A | | 8/1994 | Jones et al. | |
| 6,098,550 A | * | 8/2000 | Tsuboi | 105/29.1 |
| 6,101,952 A | * | 8/2000 | Thornton et al. | 104/282 |
| 6,629,503 B2 | * | 10/2003 | Post | 104/281 |

FOREIGN PATENT DOCUMENTS

DE 3625667 A1 1/1987

OTHER PUBLICATIONS

PCT International Search Report/Written Opinion, PCT/US06/39499, Aug. 20, 2007.

* cited by examiner

*Primary Examiner*—Mark T Le
(74) *Attorney, Agent, or Firm*—Pryor Cashman LLP; Andrew S. Langsam

(57) ABSTRACT

A toy vehicle and a track are provided. The track includes a first recess underneath a first rack and a second recess underneath a second rack opposite the first rack, and the vehicle includes a first coupler with a first lateral portion for insertion into the first recess and a second lateral portion for insertion into the second recess, such that the first lateral portion is adapted to move in the first recess and the second lateral portion is adapted to move in the second recess during motion of the vehicle along the track so as to secure the vehicle to the track. Also, magnet-coupling elements may be provided. Further, the vehicle includes gears disposed near the bottom of the vehicle, and the track includes a pair of opposed racks to cooperate with teeth of the gears to impart motion to the vehicle along the track.

10 Claims, 9 Drawing Sheets

DRIVE AND SECURE MECHANISM FOR TOY VEHICLE AND TRACK

RELATED APPLICATIONS

The present application is a continuation-in-part of U.S. patent application Ser. No. 10/686,368 filed Oct. 14, 2003, issued on May 30, 2006, as U.S. Pat. No. 7,051,948, which is a continuation-in-part of U.S. patent application Ser. No. 10/266,526 filed Oct. 8, 2002, issued on Oct. 14, 2003, as U.S. Pat. No. 6,631,850, both U.S. patent applications and the issued patent being incorporated in full by reference herein. The present Application claims priority to these U.S. applications and patent.

FIELD OF THE INVENTION

The present invention relates to toy vehicles, including toy vehicles that run on tracks, such as toy trains and the like, and to the tracks on which they run. Further, the present invention relates to toy vehicles driven by driving gears that are capable of running along tracks that are bent horizontally and/or flexed or looped vertically and couplers that secure the toy vehicles on the track while in motion on or along the track.

BACKGROUND OF THE INVENTION

Toy vehicles, such as trains that run on tracks and other types of pre-formed paths, have been a perennial favorite for generations with children of all ages. However, traditionally train and track sets typically do not allow the track to be incrementally and easily adjusted vertically and horizontally to make for a more exciting and varied deployment of the path of the train or vehicle. While there are train and track sets that allow segments of track to be joined so as to yield differently shaped track configurations, a track system that allows for horizontal adjustment and/or looping of the track in a vertical direction with respect to the motion of the vehicle running on the track poses particular problems, and yet is highly desirable from a "fun" perspective. Additional problems are posed by vehicle and track sets that provide for bending the track in a horizontal direction and in a vertical direction. Such problems include keeping the vehicle on the track while at the same time having some motion imparting mechanism that reliably engages with some portion of the track.

SUMMARY OF THE INVENTION

A toy vehicle and a track are provided. The track includes a first recess or channel underneath a first rack and a second recess or channel underneath a second rack opposite the first rack; the vehicle includes a first coupler with a first lateral portion for insertion into the first recess and a second lateral portion for insertion into the second recess, such that the first lateral portion is adapted to move in the first recess and the second lateral portion is adapted to move in the second recess during motion of the vehicle along the track so as to secure the vehicle to the track.

The first recess may be directly under the first rack or a portion thereof and the second recess may be directly under the second rack or a portion thereof.

The first coupler can include a downward projection from a bottom of the vehicle and a lip disposed at the bottom of the downward projection, and the lip can include the first lateral portion and the second lateral portion. The lip may extend substantially around the downward projection of the first coupler. A second coupler substantially similar to the first coupler may also be provided, for example such that the downward projection of the first coupler and the downward projection of the second coupler extend down to the same height.

The vehicle may also include a first driving gear and a second driving gear spaced apart from the first gear, both driving gears arranged near the bottom of the vehicle. Cooperating with such a vehicle, the track includes a first upwardly-oriented rack adapted to cooperate with teeth of the first driving gear and a second upwardly-oriented rack configured to cooperate with teeth of the second driving gear to provide motion to the vehicle along said track as said gears are mechanically rotated by a battery driven motor within the vehicle.

As the gears of the vehicle are rotated, the train moves along the track as the consequence of the gear teeth pulling and pushing against the teeth of one or both racks of the tracks. The vehicle may further comprise wheels located at either side of the vehicle, such that when the vehicle is in motion the wheels make no substantial contact with the track, but give a realistic look to the toy, reducing friction and battery wear.

One or more of the teeth of the first gear and/or the second gear may be tapered away from a rotational axis of the gears to facilitate the cooperation between the gears and the racks, independent of track configuration.

For a given longitudinal track segment of the track, the first rack may include a number of teeth different from the number of teeth comprised by the opposed second rack. For example, the first rack may have four teeth and the second rack three teeth. In such an arrangement, the first rack may have sequential evenly spaced locations A, B, C, D and E, such that teeth of the first rack are disposed at each of locations A, B, C and D, and the second rack may have sequential evenly spaced opposed locations A', B', C', D' and E', such that teeth of said second rack are disposed at each of locations B', C' and E'. Alternatively, the first rack may have teeth at each of locations A, B, C and D, and the second rack at each of locations A', B' and C'. Also, one or more teeth of the first rack may be shorter than the remaining teeth of the first rack.

In another embodiment, the vehicle may includes one or magnet-coupling elements in addition or in lieu of the mechanical non-metallic coupler of the first embodiment. Such a magnet-coupling element is adapted to hold the vehicle on the track while the vehicle is in motion, such that the magnet-coupling element is free of a mechanism for imparting motion to the vehicle, and the track includes one or more corresponding magnet-coupling elements that cooperate with the magnet-coupling element of the vehicle. One component is a magnet; the other may be a ferro-magnetic component that responds to a magnet.

The magnet-coupling element of the vehicle may include a magnet or the magnet-coupling element of the track may include a magnet. The corresponding magnet-coupling element of the track may be disposed as a slide coupled to the track, for example, the slide may be coupled to the track by one or more flanges located above and on either side of the slide. Further, for ensuring that the train stays on the track when sharp curves and/or inclines are provided to the track, the slide could include a second corresponding magnet-coupling element that cooperates with a second magnet-coupling element of the vehicle.

Also, the magnet-coupling element of the vehicle may be arranged between a left wheel and a right wheel or between a left motion-imparting pinion gear and a right motion-imparting pinion gear of the vehicle. The magnet-coupling element may be formed as a first projection disposed at the bottom of the vehicle, and a second magnet-coupling element may also be disposed at the bottom of the vehicle. For example, the second magnet-coupling element may be formed as a second, rearward projection at the bottom of the vehicle but aligned with the first projection, along the longitudinal axis of the vehicle. Such a second projection may extend further downwardly, i.e. in a direction toward the track, than the first projection.

DETAILED DESCRIPTION OF THE DRAWINGS, INVENTION AND THE PREFERRED EMBODIMENT

The following discussion considered in connection with the Drawings describe the preferred embodiments and the best mode of Applicant's invention as best understood presently by the inventor. However, it will be appreciated that numerous modifications of the invention are possible and that the invention may be embodied in other forms and practiced in other ways without departing from the spirit of the invention. Further, features of embodiments described may be omitted, combined selectively or as a whole with other embodiments, or used to replace features of other embodiments, or parts thereof, without departing from the spirit of the invention. The figures and the detailed description are therefore to be considered as an illustrative explanation of aspects of the invention, but should not be construed to limit the scope of the invention.

Figure 1:
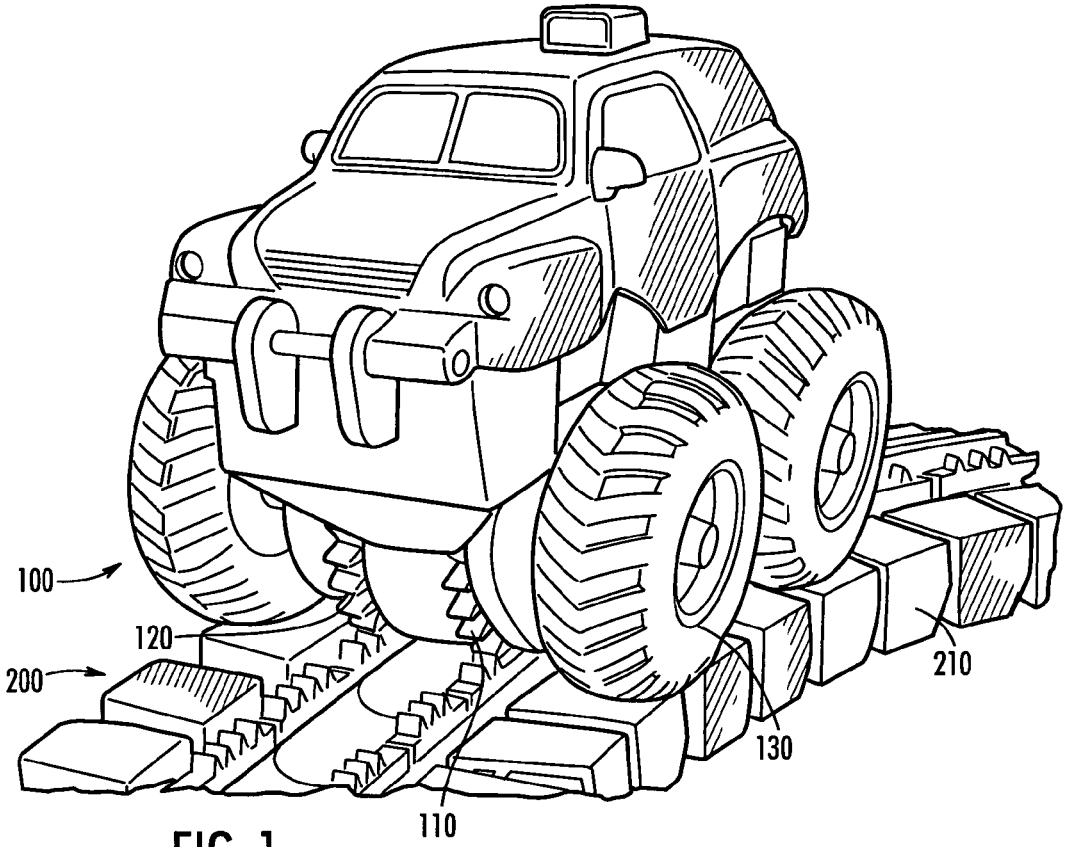
FIG. 1 illustrates a vehicle and track system according to an embodiment of the present invention.
Figure 8:
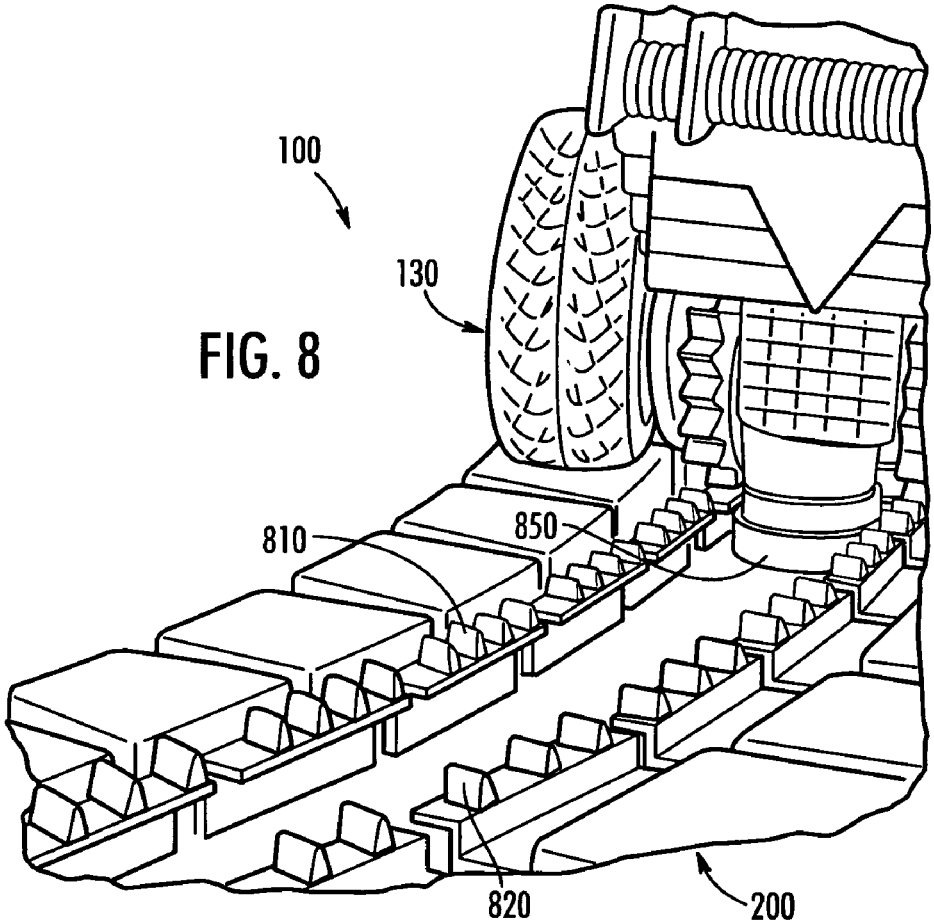
FIG. 8 illustrates a non-magnetic mechanical coupler and track, according to an aspect of the present invention.

FIG. 8 is a large-scale view of an example of a vehicle 100 and track 200 according to an aspect of the present invention. FIG. 1 shows the vehicle 100 as a truck or monster truck with large wheels 130. It will be understood however, that the vehicle 100 may also have the appearance of a train, including a train engine or train car, automobile, tractor, motorcycle, a skateboard, surfboard, or other type of terrestrial or non-terrestrial vehicle. Also, while the vehicle 100 is shown in FIG. 8 as having four large wheels (two wheels (and a part of the third) are visible), the vehicle 100 with more or fewer wheels is also contemplated, as is the vehicle 100 with no wheels. Also, certain types of all-terrain vehicles, such as tractors or tanks have wheels of a different type from the type shown, for example continuous chain treads, and are also contemplated. FIG. 8 also shows a coupler 850 comprising a downward projection, and a first rack 810 and an opposed second rack 820, both with upwardly oriented teeth.

Figure 9:
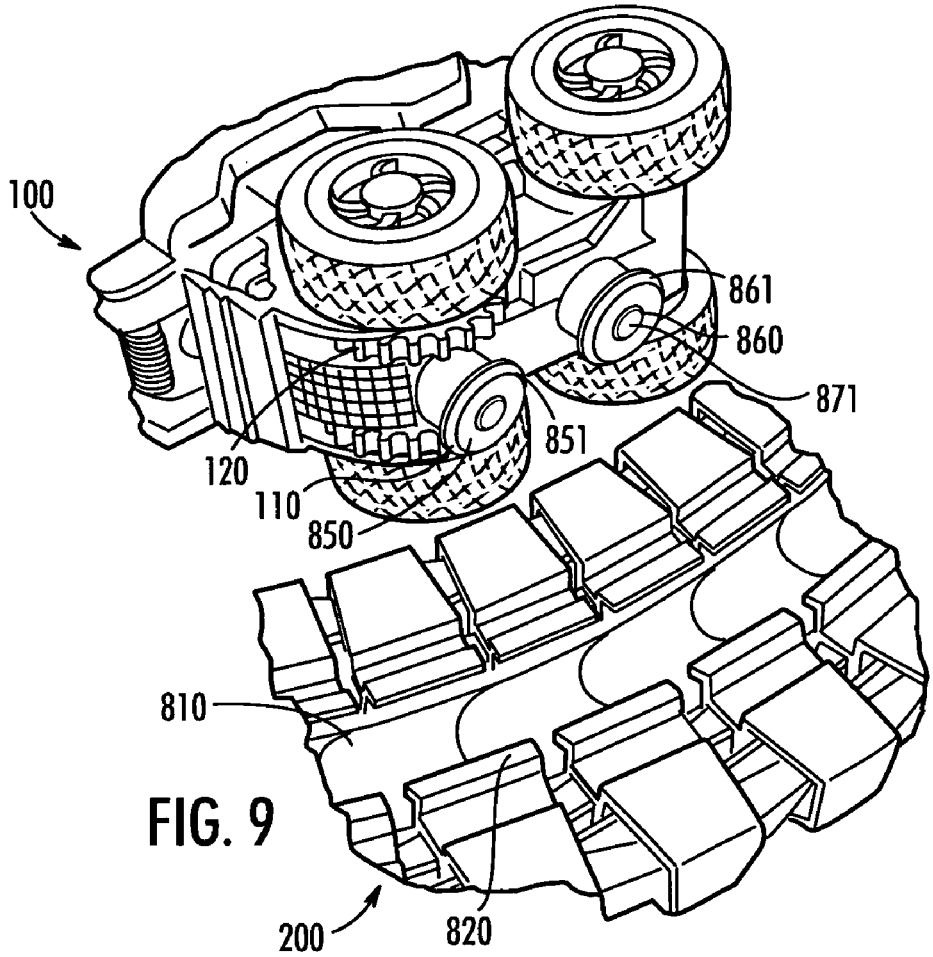
FIG. 9 is a view of the bottom and side of the vehicle and the track with the mechanical coupler, according to an aspect of the present invention.

FIG. 9 shows the bottom of the vehicle 100 with a first coupler 850 comprising a downward wheel-like projection with a lower lip 851 (of slightly greater diameter than the main portion of the projection) that extends all the way around and at the bottom of the downward wheel-like projection of a coupler 850. A second coupler 860 includes a downward projection with second lip 861 that extends all the way around and at the bottom of the downward projection of the second coupler 860.

The first rack 810 is shown in FIG. 9 as having four upwardly oriented teeth and the second rack 820 is shown as having three upwardly oriented teeth for each segment of track. In this embodiment, for each longitudinal segment of track, the first tooth of the second rack 820 is disposed at a location substantially opposite the second tooth of the first rack 810, while at the location in the second rack 820 opposite the location of the fourth tooth of the first rack 810 no tooth is provided in the second rack 820. Basically, first rack has four teeth in the first four of five possible teeth locations while second rack has three located in locations two, three and five of possible teeth locations.

Figure 10A:
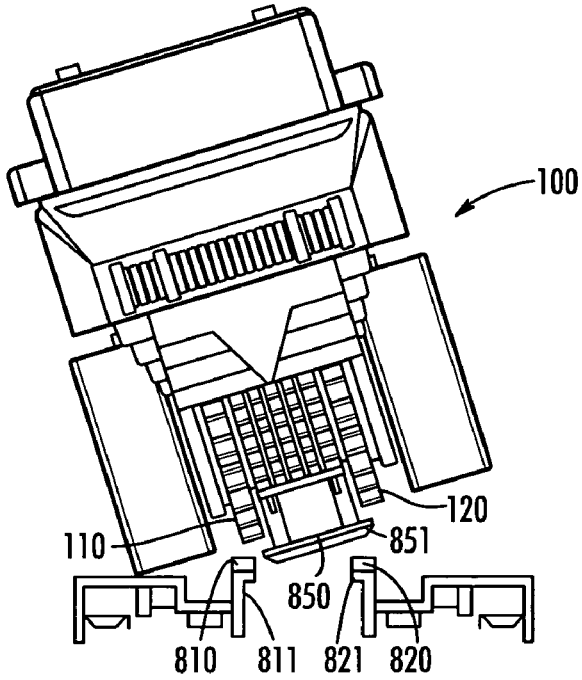
FIG. 10*a* is a schematic illustration of the vehicle as lateral portion of the lip of the mechanical coupler is slid into a recess formed immediately below the first rack of the track, according to an aspect of the present invention. The chamfered edge of the lips facilitates location of the vehicle onto the track.
Figure 10B:
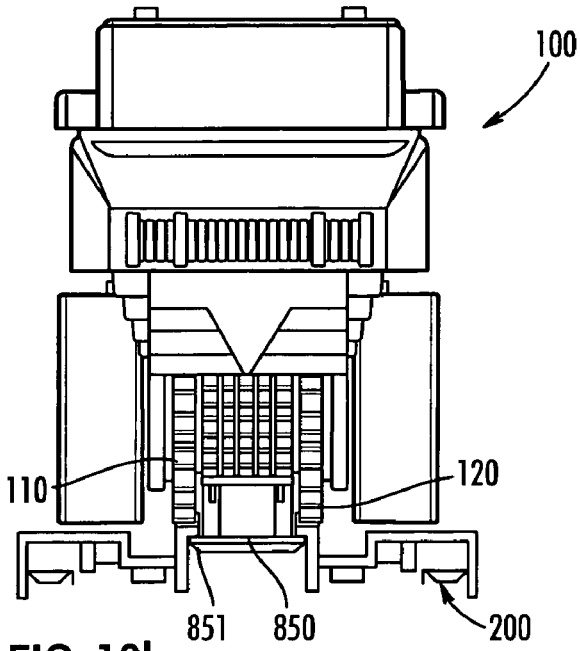
FIG. 10*b* is a schematic illustration of the position of the coupler of the vehicle when properly engaged for motion along the track, according to an aspect of the present invention.

FIG. 10*b* shows the position of the coupler 850 of the vehicle 100 when properly engaged for motion along the track 200. Coupler 850 is disposed as a downward projection from the vehicle 100 and is shown as having a chamfered lip 851. As shown in FIG. 10*a*, a lateral portion of the lip 851 is slid into recess 811 formed immediately below the first rack 810 of the track 200. The opposite side of the lip 851 is then inserted into recess 821 formed below the second rack 820 of track 200. In this way the vehicle 100 is kept on the track 200 while in motion, even if the vehicle 100 is in an upside-down position when the track 200 is looped. That is, when the vehicle 100 is in an upside-down position or close to an upside-down position, the bottom of the first rack 810 defining the top of the first recess 811 and the bottom of the second rack 820 defining the top of the recess 821 keep the lateral portions of the lip 851 in the recesses 811 and 821 and thus prevent the vehicle 100 from falling off the track 200. Similarly, the lip-in-recess arrangement may help to secure the vehicle 100 to the track 200 during acceleration, deceleration or jerky movement of the vehicle 100, or when centrifugal forces are acting on the vehicle 100 when making sharp bends or the like, as a result of the track 200 being bent.

While the recess 811 is shown as being defined by the bottom of the first rack 810, it will be understood that such a recess 811 may be defined by or formed in some other structure of the track 200 without departing from the spirit of the present invention. Similarly, recess 821 need not be defined by the second rack 820. For example, couplers 850 and 860 extend farther down than those shown, the recesses or some type of groove or slot may be provided in the track 200 without use of the racks 810 and 820 to define them.

Also, while lip 851 is shown as surrounding the entire bottom portion of the downward projection of the coupler 850, it will be understood that a first lateral portion that cooperates with recess 811 and a second lateral portion that cooperates with recess 821 may be provided on either side of the downward projection of the coupler 850 without a lip that substantially surrounds the entire downward projection of the coupler 850. A wheel-like lip, however, which is rotatable about a vertical axis will reduce friction between vehicle and track and add to realism. Similarly, the lip 851 or the lateral portions that cooperate with the recesses 811 and 821 may be formed higher in the downward projection of the coupler 850. Also, while FIG. 9 shows the downward projection of the first coupler 850 as being substantially cylindrical or truncated cone-shaped with a lip 851 at the bottom, the downward projection of the first coupler 850 may be box shaped, rectangular, or rectangular and tapered toward or away from the vehicle 100, pyramid-shaped, or some combination of the foregoing shapes.

As shown in FIG. 9, the vehicle 100 may also include one or more additional couplers, such as second coupler 860 including a downward projection with a second wheel-like lip 861 rotatable, too, about a vertical axis, 871. The lateral portions of the lip 861 cooperate with the same recesses 811 and 821 formed in the track 200. Also, second lip 861 of the second coupler 860 may include a lateral portion only on the first side so long as the vehicle 100 is reliably kept on the track 200.

Figure 11:
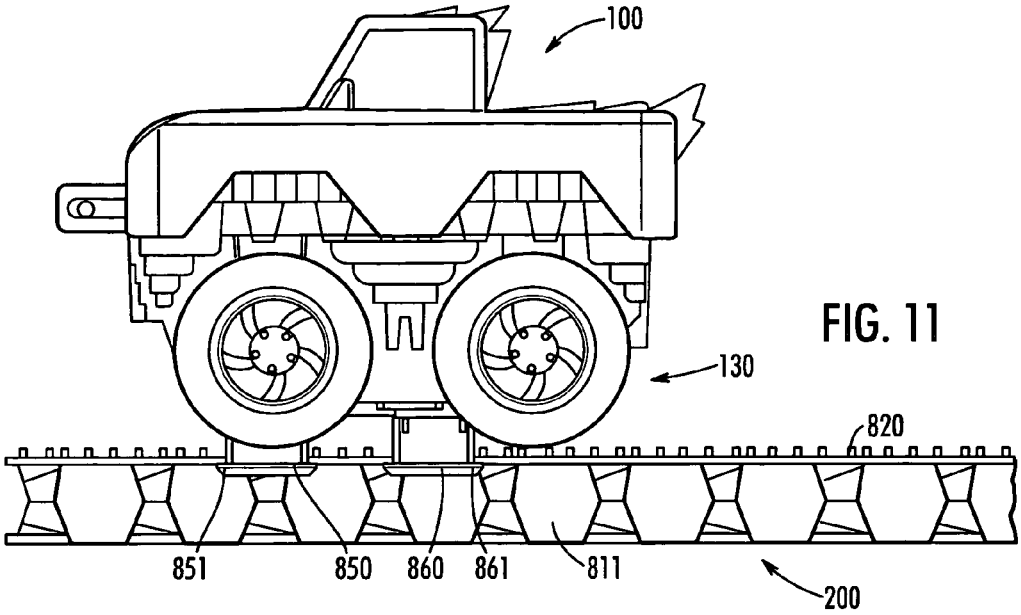
FIG. 11 is a schematic illustration of a view of the vehicle when properly engaged on the track for motion thereon, according to an aspect of the present invention (Note that the wheels are suspended slightly above the track to provide a realistic appearance but no friction therebetween).

FIG. 11 is a schematic illustrating a view of the vehicle 100 when properly engaged on the track 200 for motion thereon. The lips 851 and 861 of the couplers 850 and 860, respectively, are shown just below the rack 820. The lateral portion is inside the recess 811 whose upper wall is defined by the bottom of rack 820. The wheels 130 on the side of the vehicle 100 are disposed on the outside of the rack 820 and may be just for show to provide a more realistic look for vehicle 100. Indeed, they are slightly suspended above the track, to reduce friction and battery wear.

Figure 12:
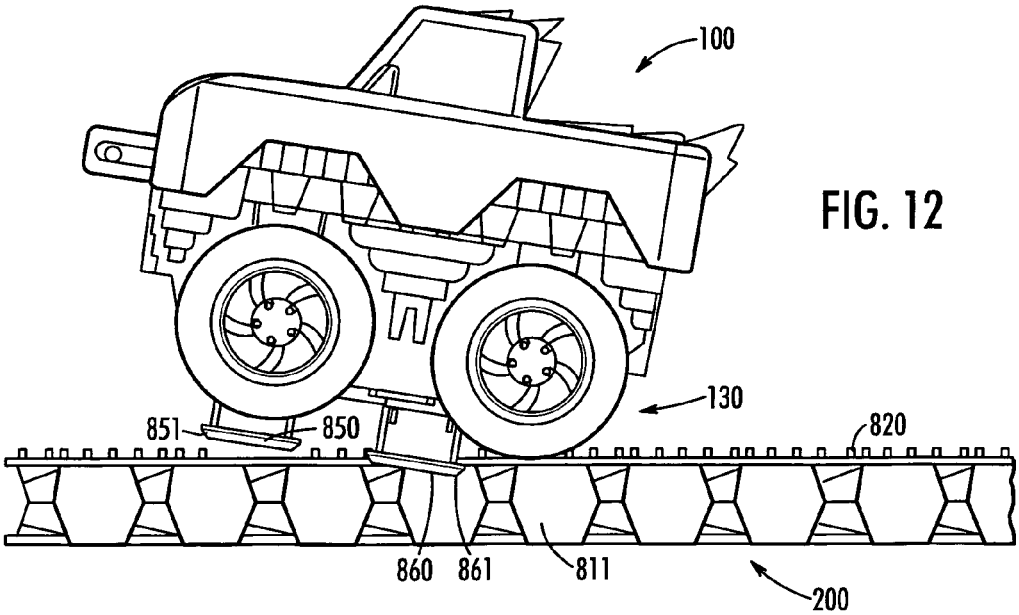
FIG. 12 is a schematic illustration of the vehicle as the lip of the downward projection of the coupler is being placed on the track, according to an aspect of the present invention.

FIG. 12 shows the vehicle 100 as the lip 861 of the downward projection of the coupler 860 of the vehicle 100 is being placed on the track 200. As also shown in FIG. 10*a*, the lateral portions of the lips 851 and 861 of each of the downward projections of the couplers 850 and 860 have to be inserted into the recesses 811 and 821 of the track 200. The chamfered edge provided by the lips facilitates placement of the vehicle on the track yet inhibits accidental removal.

FIG. 10*a* also shows the first driving gear 110 and the second driving gear 120 of the vehicle 100. Teeth of the first driving gear 110 and the second driving gear 120 of the vehicle 100 engage the first rack 810 and the second rack 820 of the track 200 and impart motion to the vehicle 100 as the first gear 110 and the second gear 120 are mechanically rotated by the drive mechanism (not shown) of the vehicle 100. That mechanism includes a motor, battery source and mechanical gearing to rotate the driving gears. The gear and rack mechanism shown in FIG. 10*a* may be similar to the gear and rack mechanism discussed and illustrated with respect to the magnetic-coupling element embodiment of the present invention, discussed below.

It will be understood however, that the approach using couplers 850 and 860 and recesses 811 and 821 may be used without the driving gear and toothed rack mechanism discussed herein without departing from the spirit of the present invention. For example, instead of the gear and rack mechanism, traditional wheels may be used to impart motion to the vehicle 100 along the track 200, or other types of motion imparting solutions may be used, including maglev or magnet-based driving systems, or the like.

Figure 13A:
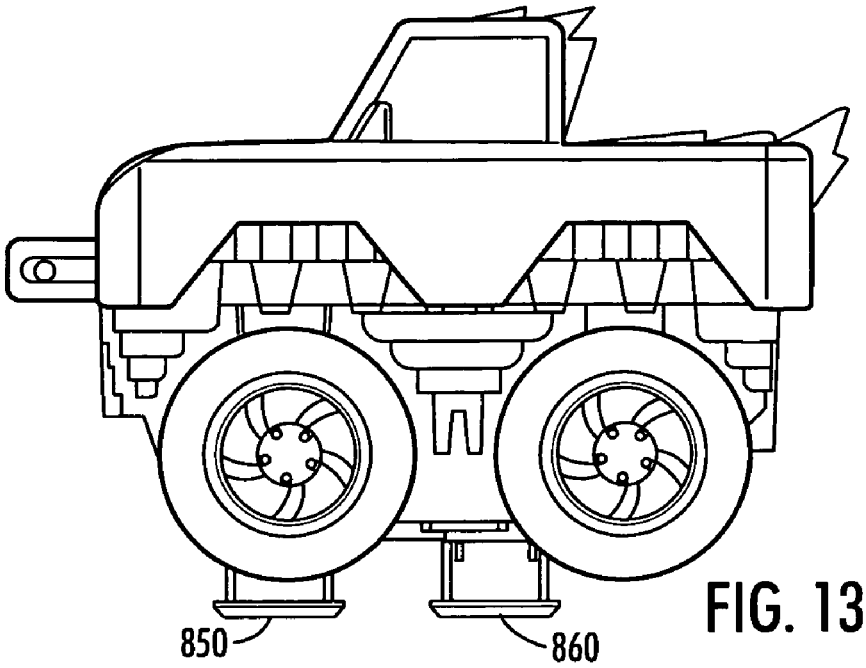
FIGS. 13*a* and 13*b* are schematic illustrations providing an example of the preferred dimensions (in mm.) of features, and distances between features, according to an embodiment of the present invention.
Figure 13B:
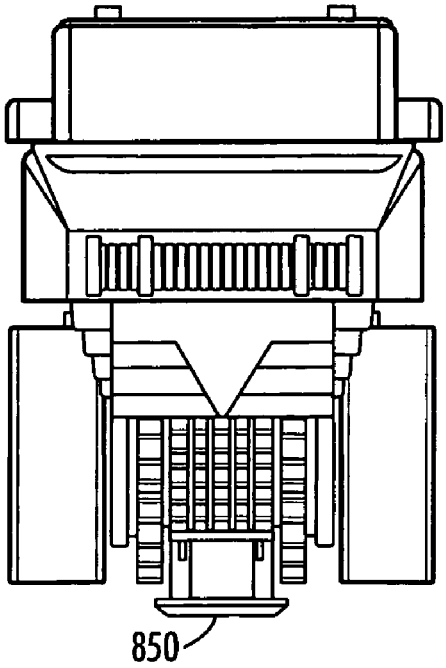

FIGS. 13*a* and 13*b* provide an example of the dimensions of features and distances between features of an embodiment of the present invention. For example, according to an embodiment of the present invention as shown in FIG. 13*a*, the distance between the center of the bottom of the first coupler 850 and the center of the bottom of the second coupler 860 is 25 mm. However, it will be understood that the dimensions illustrated in FIG. 13*a* and FIG. 13*b* are provided only as an illustrative example of an embodiment, according to one aspect of the present invention. FIGS. 13*a* and 13*b* show the dimensions of the lip, its chamfered edge, and wheel to wheel and related dimensions.

Figure 2:
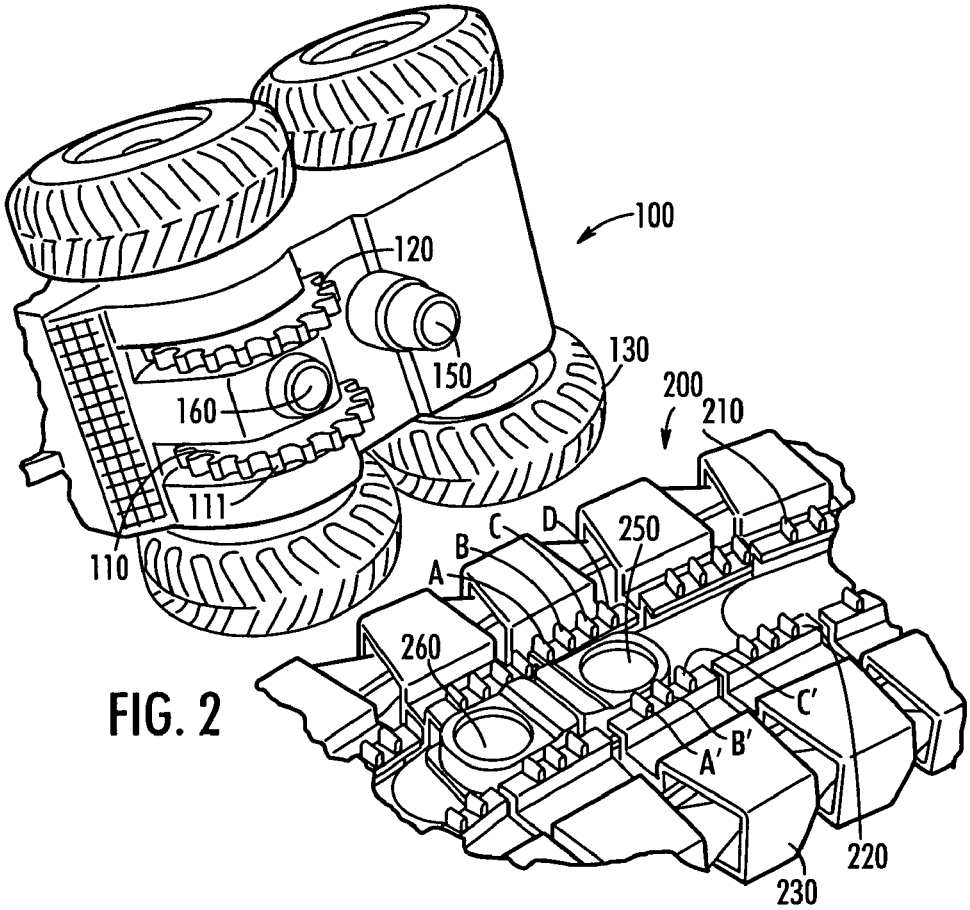
FIG. 2 illustrates the underside of a vehicle (lying on its side for illustration) and a slide mechanism disposed on the track according to an embodiment of the present invention.

FIG. 2 shows another embodiment of the present invention with a first magnet-coupling element 150 disposed on an underside of the vehicle 100 and the second magnet-coupling element 160 also disposed on the underside of the vehicle 100, and in this case, the first magnet-coupling element 150 is aligned but ahead the second magnet-coupling element 160. FIG. 2 shows the first magnet coupling element 150 and the second magnet coupling element 160 as each being substantially cylindrical or truncated cone shaped, such that they mate with, engage or cooperate with magnet coupling element 250 and second magnet coupling element 260, respectively. According to an aspect of the invention, the two magnet coupling elements 150 and 160 of the vehicle 100 are disposed substantially on or near a centerline of the underside of the vehicle 100 and the corresponding magnet coupling elements 250 and 260 of the track 200 are disposed substantially on or near a centerline of the track, however it will be understood that the magnet coupling elements may be disposed on other portions at or near the underside of the vehicle so long as they are able to cooperate with the corresponding magnet coupling element or elements of the track 200. For example, two or more magnet coupling elements may be arranged side by side on an underside of the vehicle 100 or on a lateral portion of the vehicle 100 with corresponding magnet coupling elements of the track provided accordingly. According to an aspect of the present invention, one magnet coupling protruding element of the vehicle 100 (or of the track) may protrude further toward its corresponding magnet coupling element than the second or the remaining magnet coupling protruding elements. For example, the first magnet-coupling element 150 may protrude, i.e. extend toward the track, further than the second magnet-coupling element 160 of the vehicle, by being shaped as a longer cylinder, or by being provided on a lower portion of the vehicle.

FIG. 2 also illustrates a first driving gear 110 with gear teeth 111 and a second driving gear 120 disposed at an underside of the vehicle 100. The first gear 110 cooperates with a first rack 210 of the track and the second gear 120 of the vehicle 100 cooperates with a second rack 220 of the track 200. A track segment may be understood as a physically integrated length of track that is adapted to be coupled with at least one other track segment by a user of the toy during assembly of the track. It will be noted that according to an aspect of the present invention, as shown in FIG. 2, for each track segment 230 of the track 200, the first rack 210 has four teeth while the second rack 220 of the track segment 230 has only three teeth. Also, according to an embodiment of the present invention (not shown) a fifth tooth may be provided, and one or more teeth of one or both of the racks may be shorter than the remaining teeth of the track segment. Further, for each track segment 230 of the track 200, other combinations of numbers of teeth may be used, for example, 3 and 2, 3 and 3, 4 and 4, 5 and 4, 5 and 5, 6 and 5, 6 and 6, 7 and 6, and so on. According to a preferred embodiment of the present invention however, for each track segment of the track 230, the first rack 210 has four teeth while the second rack 220 has three teeth. Each track segment 230 is thus able with respect to its adjacent track segment 230 to provide a train track that is variable in both the horizontal and vertical plane to provide curves and loops/hills while allowing the vehicle to be pulled and pushed by mechanical cooperation between driving gears and teeth of the track.

Figure 3:
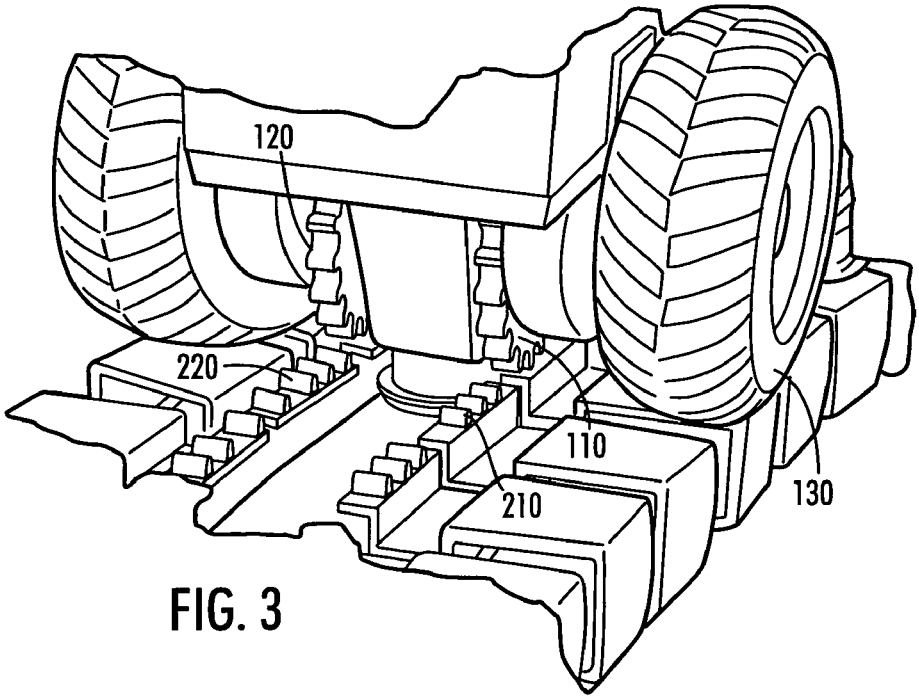
FIG. 3 is a close-up view of two gears disposed on the underside of the vehicle engaged with racks on topside of the track according to an embodiment of the present invention.

FIG. 3 is a close-up view of the two gears 110 and 120 disposed on an underside of the vehicle engaged with two racks 210 and 220 on a topside of the track according to an embodiment of the present invention. FIG. 3 illustrates the first gear 110 of the vehicle 100 engaged with teeth of the first rack 210 of the track 200, while the second gear 120 is shown as engaged with teeth of the second rack 220 of the track 200. Note also that according to an aspect of the present invention, wheel 130 is shown is suspended above the track, i.e., is not providing contact or friction with any portion of the track 200; accordingly, wheel 130 has only an ornamental function and creates no friction with the track 200. FIG. 3 also shows the engagement of the first and second magnet-coupling element of the vehicle with the magnet-coupling element of the track.

Figure 4:
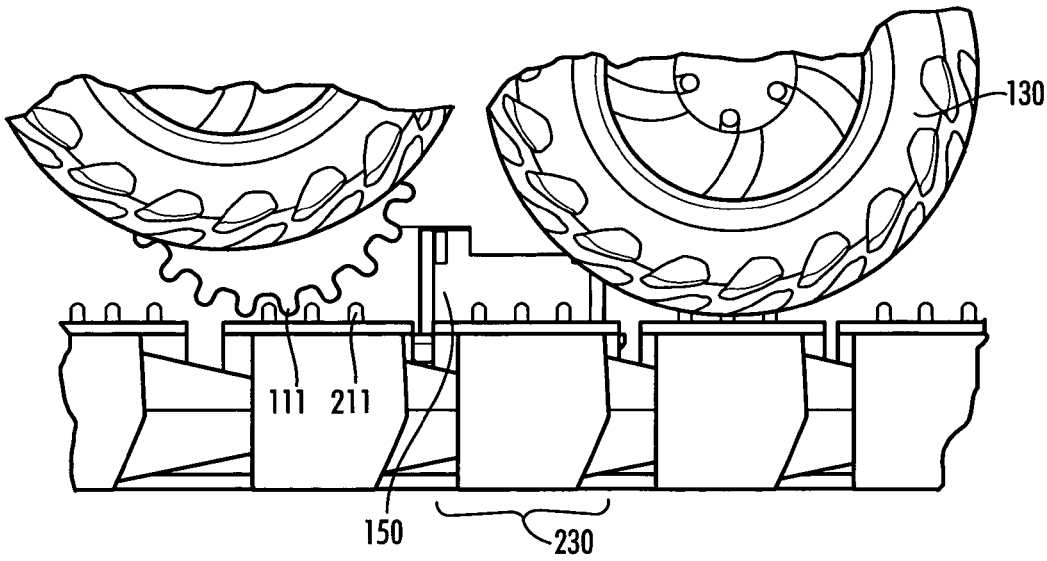
FIG. 4 is a lateral view of a first gear of the vehicle engaged with a first rack of the track and a first magnet-coupling element of the vehicle engaged with a magnet-coupling element of a slide of the track according to an aspect of the present invention.

FIG. 4 is a lateral close-up view of the engagement of a tooth 111 of the first gear 110 of the vehicle 100 with a tooth 211 of the first rack 210 of the track 200. It will be understood that as the first gear 110 is made to turn by a motor or engine (not shown) of the vehicle 100, a portion of the tooth 111 of the first gear 110, such as a top portion and/or a lateral portion of the tooth 111 of the first gear 110 pushes against a side of the tooth 211 of the first rack 210 of the track 200, thereby causing motion to the vehicle 100 along the length of the track 200 in a forward or backward direction.

Figure 5:
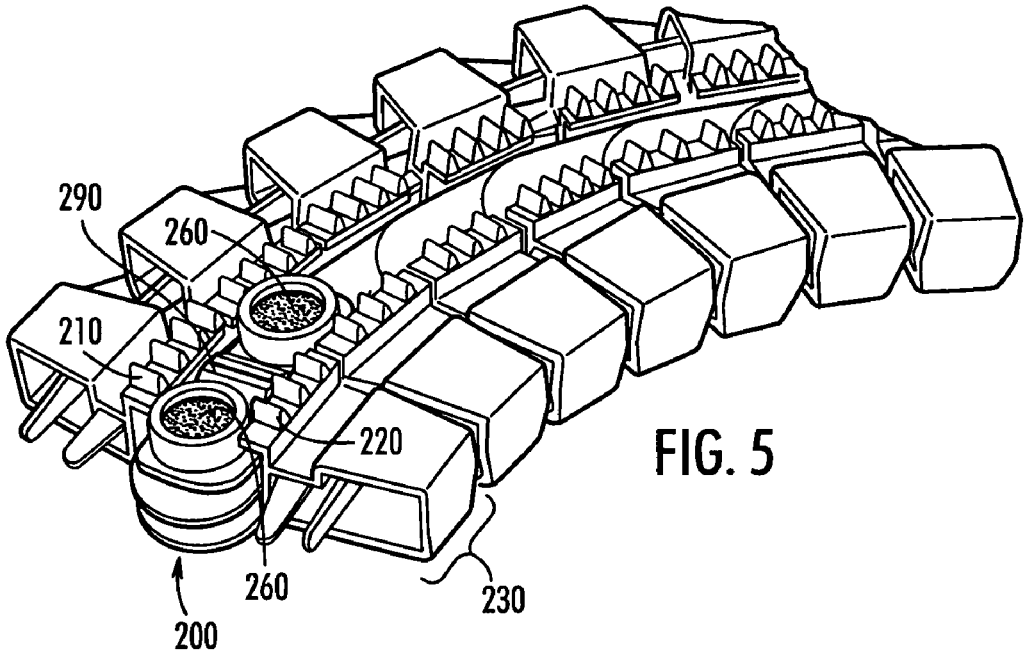
FIG. 5 illustrates the slide comprising two magnet-coupling elements of the track located between and held in a channel below the racks of the track according to another aspect of the present invention.

FIG. 5 is an elevational close-up view of a section of the track 200, including a slide 290 arranged on the track 200 between the first rack 210 and the second rack 220. The slide 290 is comprised of two magnet-coupling elements: a first magnet coupling 250 and a second magnet-coupling element 260.

Figure 6:
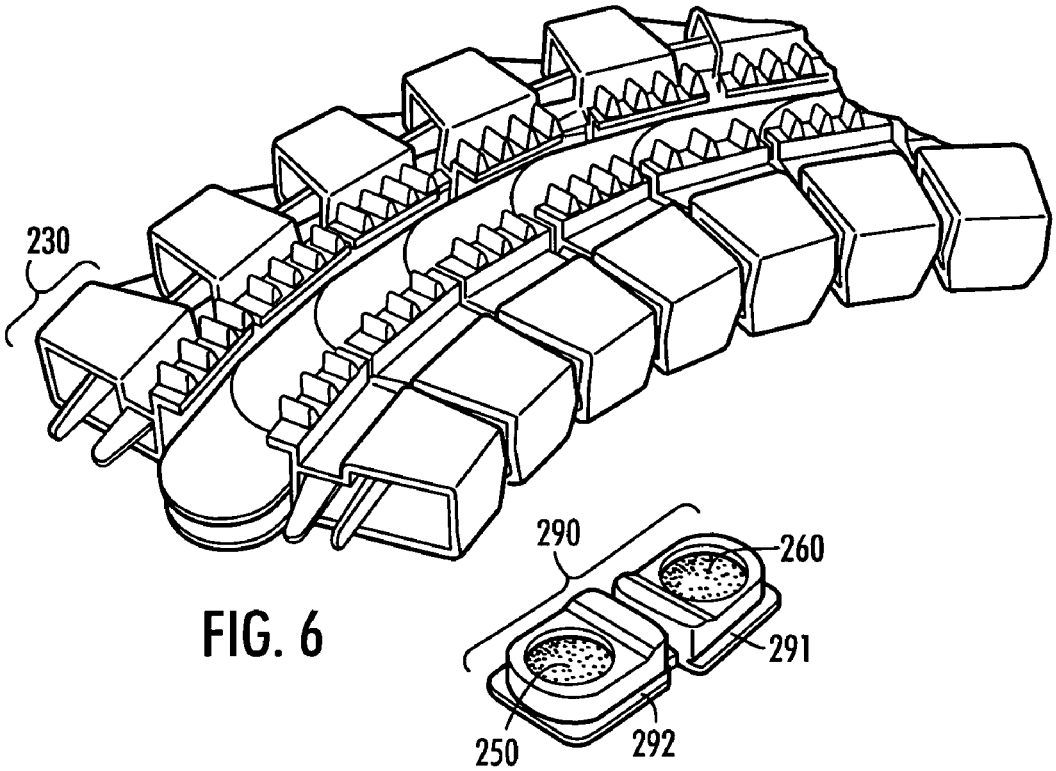
FIG. 6 shows the slide comprising two magnet coupling elements and the track according to an aspect of the present invention.

As shown in FIG. 6 (the slide being removed from the track for ease of illustration), the magnet coupling elements 250 and 260 of the slide 290 have flanges 291 and 292 disposed on a side thereof to engage with one or more grooves (not shown) arranged in the inner sides of the track 200 (below the racks) in order to hold the slide 290 along or in the track 200 while allowing the slide 290 to move along the track 200 with the vehicle 100. It will be understood that another flange (not visible from the present angle) may be located on the other side of each of the magnet coupling elements 250 and 260 of the slide 290 to make for a more secure coupling of the slide 290 with the track 200. Also, while the slide 290 is shown as having two magnet coupling elements, it will be understood that one or more than two magnet coupling elements may be provided, so long as they are able to cooperate with the magnet coupling elements of the vehicle 100. Moreover, while the magnet coupling elements 250 and 260 are shown as disposed in a single slide 290, they may instead be independently coupled with the track 200. According to an aspect of the present invention, the flanges of the slide ride within a pair of opposed grooves in the center of the track between yet below the racks.

Figure 7:
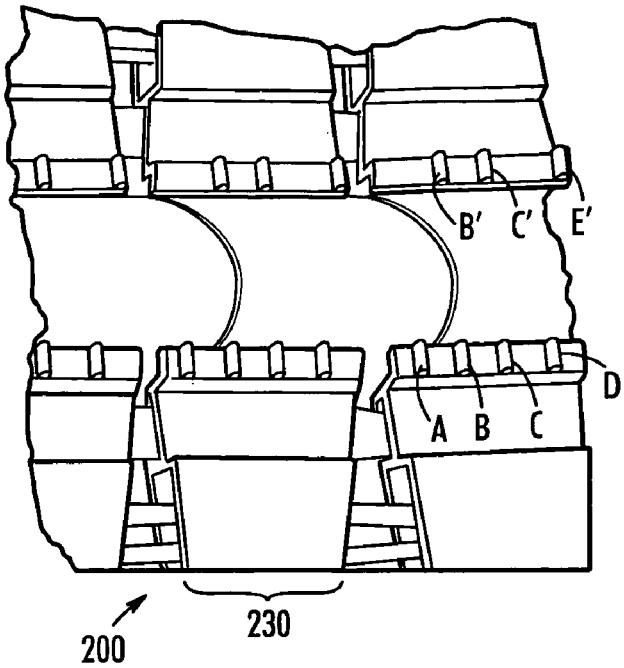
FIG. 7 illustrates track segments with teeth of the first and second racks arranged according to an aspect of the present invention.

As shown in FIG. 7, according to an aspect of the present invention the first rack 210 and the second rack 220 have a different number of teeth for each track section 230. According to the embodiment shown in FIG. 7, the first rack 210 has four teeth arranged at positions A, B, C, and D and the second rack 220 has only three teeth at positions B', C' and E', such that each of the positions A and A', B and B', C and C', D and D', and E and E' are corresponding positions on the two racks (corresponding positions means that lines drawn between corresponding positions would be substantially perpendicular to the motion of the vehicle 100 along the track segment 230).

An operation of the vehicle and track system according to an aspect of the present invention will now be described. A user (not shown) of the vehicle and track system may bend or twist the track as desired, including hills, slopes and turns, even looping the track such that the track makes a 360° twist in a vertical and/or horizontal direction. This is possible, because clearance provided between track segments 230 of the track 200 allows the track 200 to be bent, flexed, or twisted or looped as desired by the user. In this way, it is possible to have a track looped, such that the vehicle 100, moving along the length of a track 200 would first be almost perpendicular to the ground and then be upside down with respect to the ground before completing the loop of the track 200 and returning to an up-side-up position on the track 200. Accordingly, the couplers 850 and 860 of the vehicle 100 are secured in the recesses 811 and 821 of the track 200 and thereby secure the vehicle 100 to the track 200 while the vehicle is in motion along the length of tracks 200. Alternatively, according to the magnet-based embodiment of the present invention, magnet-coupling elements 150 and 160 cooperate with corresponding magnet coupling elements 250 and 260 of the slide 290 of the track 200 to secure the vehicle along or near the track 200 while in motion along the length of the track 200.

According to an aspect of the present invention, gears of the vehicle 100 engage with racks 210 and 220 of the track 200 to provide a motion imparting mechanism even when the track is bent in a substantially horizontal plane and/or when the track is flexed or looped in an upward or downward direction and combinations thereof. Accordingly, because the vehicle 100 is held securely at or near an upper surface of the track 200, the teeth 111 of the driving gears 110 and 120 of the vehicle 100 are able to engage the teeth 211 of the racks 210 and 220 of the track 200, or at least portions of the teeth of the racks of the track 200 to impart thereby a forward or backward momentum along the track 200 to the vehicle 100.

In addition, according to an aspect of the present invention, for each segment of track, a number of teeth of the rack on the one side differs from the number of teeth on the rack of the opposed side of the track. As shown in FIG. 2, for each track segment 230, preferably the first rack 210 has four teeth, while the second rack 220 has only three aligned teeth. Further, for each track segment 230, rack 210 has evenly spaced teeth at positions A, B, C and D, while second rack 220 has evenly spaced teeth located at position A', B' and C'.

According to an aspect of the present invention, because a different number of teeth are provided on a first and the opposed side of the track 200, motion imparting contact between the teeth of the gears 110 and 120 on the vehicle 100 and the teeth of the racks 210 and 220 of the track 200 exists even when the track is bent or flexed at sharp angles. Since an angle of contact between teeth of the driving gears of the vehicle 100 and teeth of the rack of the track 200 on the first side may vary slightly from an angle of contact of teeth of the gears of the vehicle 100 with teeth of the rack of the track 200 on the opposed side, as the track 200 is bent or flexed, engagement or contact between some of the teeth is thus made more certain. Accordingly, according to an aspect of the present invention, not only does the vehicle 100 not derail as the track is bent flexed or twisted, but contact between some teeth of the driving gears of vehicle 100 and teeth of at least one of the racks of the track 200 is always maintained. As a result, the gears and the racks maintain their corresponding relationships, and the gears by their contact with the teeth of at least one of the racks of the track 200 continue to provide motion along the track 200 to ensure that the vehicle 100 continues on its path.

According to another embodiment of the present invention however, for each track segment 230, rack 210 has evenly spaced teeth A, B, C and D, while rack 220 has evenly spaced teeth A', B' and C'. In other words, according to this embodiment, rack 220 lacks teeth at locations D' and E' in each track segment. This allows for constant motion of the vehicle on the track even though the track may be twisted or turned, up-side-down, since at least one of the gears (and one gear tooth) will be able to push against at least one of the teeth of one of the racks at all times, thus maintaining motion of the vehicle and yet, the elimination of one (or more) rack teeth on one side reduces "pinching" of the gears by the racks when the track is configured with high angles or bend/curvature.

It will be understood, that more or fewer magnet coupling elements may be used as necessary for the weight, maximum attainable speed and size of the vehicle 100, and depending on the size of each of the magnet coupling elements of the vehicle 100. According to an aspect of the invention, the corresponding magnet coupling elements 250 and 260 of the slide 290 of the track 200 comprise magnets. Alternatively, the magnet coupling elements 150 and 160 of the vehicle 100 may comprise magnets. In either event, the opposed magnet-coupling elements, on the slide or on the vehicle, comprise attractable ferro-magnetic material or magnets of opposite polarity. Also, while the present invention is illustrated as embodied in a vehicle with magnet coupling elements 150 and 160 that protrude toward or into the corresponding magnet coupling elements 250 and 260 of the slide 290 of the track 200, it is instead possible to have the magnet coupling elements 250 and 260 of the slide 290 of the track 200 protrude toward the vehicle 100 and be formed in the shape of a cylinder, cone or truncated cone, pyramidal, rectangle, square or other shape, or to have one or more magnet coupling elements of the vehicle 100 and one or more magnet coupling elements of the track 200 each protrude to a corresponding magnet coupling element to receive or accommodate the protruding magnet coupling element. Further, while the example of the protruding element described herein may be cylindrical, truncated cone shaped, or pyramidal, it will be understood that one or more, or all of the magnet coupling elements may be shaped in other ways, for example, the magnet coupling elements may be spherical, rectangular, square, triangular, irregular shaped, or shaped in other ways, so long as the corresponding magnet coupling element is shaped in a manner to accommodate or receive it. According to an aspect of the invention, the slide is maintained on the track by the flanges of the slide riding in opposed grooves in the center of the track. The bottom of the slide may be flat and may glide within the flat center of the track, between yet beneath the grooves.

It will also be noted that according to an aspect of the present invention, as shown in FIG. 3, teeth of the first gear 110 and the second gear 120 of the vehicle 100 are tapered toward their ends at which they cooperate with the first rack 210 and the second rack 220, respectively, of the track 200. Such tapering of the teeth of the gears according to an aspect of the present invention seems to make it easier to place the vehicle 100 onto the track 200 to create a cooperating relationship between the teeth of the gears and the teeth of the racks of the track 200, and to maintain engagement with the teeth of the racks when the track 200 is flexed, bent or looped. However, a non-tapered gear tooth configuration is also contemplated. Of course it will be appreciated that the teeth of the racks could be tapered and/or the teeth of the driving gears tapered or non-tapered.

Preferred embodiments and methods of the present invention discussed in the foregoing are to be understood as descriptions for illustrative purposes only, and it will be appreciated that numerous changes, substitutions, omissions, and updates thereof are possible without departing from the spirit and scope of the claims. The scope of the invention is defined by the below-set forth claims.

What is claimed is:

1. A toy vehicle and a track, comprising:

the vehicle including at least:

a first magnet-coupling element adapted to hold the vehicle on the track while the vehicle is in motion, the first magnet-coupling element being free of a mechanism for imparting motion to the vehicle, the magnet-coupling element comprising a first downwardly directed projection disposed at the bottom of said vehicle; and a second magnet-coupling element disposed at the bottom of the vehicle as a second downwardly directed projection at the bottom of said vehicle, said second projection extending further downwardly than said first projection;

the track including at least one corresponding magnet-coupling element that cooperates with at least one of the magnet-coupling elements of the vehicle so as to secure the vehicle to said track during relative movement of said vehicle along said track, wherein the corresponding magnet-coupling element of the track is disposed in a slide mechanically coupled to yet longitudinally movable along said track.

2. The vehicle and the track of claim 1, wherein one of a) at least one of the magnet-coupling elements of the vehicle, and b) the magnet-coupling element of the track comprises a magnet, and the other of a) and b) comprises a ferro-magnetic material.

3. The vehicle and the track of claim 1, wherein one of a) at least one of the magnet-coupling elements of the track, and b) the magnet-coupling element of the vehicle comprises a magnet, and the other of a) and b) comprises a magnet with an end of opposite polarity, disposed toward the former one of a) and b).

4. The vehicle and the track of claim 1, wherein said slide is coupled to said track by one or more side flanges gliding in one or more side grooves in said track.

5. The vehicle said the track of claim 1, wherein said slide comprises a second corresponding magnet-coupling element that engages with the second magnet-coupling element of said vehicle to secure said vehicle to said track and yet allow relative longitudinal movement of said vehicle along said track.

6. The vehicle and the track of claim 1, wherein at least one of the magnet-coupling elements of said vehicle is disposed between opposed wheels or between opposed driving gears of said vehicle.

7. A toy vehicle and a track:

said vehicle comprising at least one magnet-coupling element adapted to hold the vehicle onto the track while the vehicle longitudinally moves along said track, said magnet-coupling element being free of a mechanism for imparting motion to the vehicle;

said track including at least one corresponding magnet-coupling element disposed on a slide that mechanically cooperates with said magnet-coupling element of said vehicle to maintain said vehicle onto said track and yet allow relative movement of said vehicle along said track;

said vehicle including a first driving gear and a second driving gear laterally spaced apart from said first gear, both said first gear and said second gear disposed near the bottom of said vehicle; said vehicle further comprising a driving mechanism for rotating said first and second driving gears; and said track including a first rack configured to cooperate with teeth of said first gear, and a second rack spaced apart from said first rack and configured to cooperate with teeth of said second gear to impart motion to the vehicle along said track, when said gears are mechanically rotated, wherein for a given length of said track segment of said track, the number of teeth of said first rack is greater than the number of teeth of said second rack.

8. The vehicle and the track of claim 7, wherein for said given length of said track segment, the number of teeth of said first rack is four and the number of teeth of said second rack is three.

9. The vehicle and the track of claim 7, wherein for said given length of said track segment, said first rack comprises sequential evenly spaced teeth locations A, B, C, D, and E, such that a tooth of the first rack is disposed at locations A, B, C, and D, and wherein said second rack comprises sequential evenly spaced and opposed teeth locations A', B', C', D' and E', such that a tooth of the second rack is disposed at locations B', C' and E'.

10. The vehicle and the track of claim 7, wherein for said given length of said track segment, said first rack comprises sequential evenly spaced teeth locations A, B, C, D, and E, such that a tooth of the first rack is disposed at locations A, B, C and D, and wherein said second rack comprises sequential evenly spaced opposed teeth locations A', B', C', D' and E', such that a tooth of said second rack is disposed at of locations A', B' and C'.

* * * * *